United States Patent [19]

Seeger

[11] 4,416,313

[45] Nov. 22, 1983

[54] DOUBLE ACTING LOG SPLITTER

[75] Inventor: Richard E. Seeger, Kittery Point, Me.

[73] Assignee: Armatron International, Inc., Melrose, Mass.

[21] Appl. No.: 316,884

[22] Filed: Oct. 30, 1981

[51] Int. Cl.[3] ..... B27L 7/00

[52] U.S. Cl. ..... 144/193 R; 74/89.15; 74/424.8 R; 144/193 E

[58] Field of Search ..... 74/89, 89.15, 424.8; 144/193 R, 193 A, 193 C, 193 K, 193 E

[56] References Cited

U.S. PATENT DOCUMENTS

| | | | |
|---|---|---|---|
| 111,333 | 1/1871 | Ficht | 144/193 R |
| 4,121,636 | 10/1978 | James | 144/193 R |
| 4,223,707 | 9/1980 | Jensen et al. | 144/193 R |
| 4,310,039 | 1/1982 | O'Brien | 144/193 A |

FOREIGN PATENT DOCUMENTS

| | | | |
|---|---|---|---|
| 231752 | 4/1944 | Switzerland | 144/193 R |

*Primary Examiner*—W. D. Bray

*Attorney, Agent, or Firm*—Thompson, Birch, Gauthier & Samuels

[57] ABSTRACT

A double acting log splitter has a longitudinally extending frame with a pair of mutually spaced fixed splitting components located along the length thereof. A movable splitting component is mounted on a carriage which is movable in opposite directions along the length of the frame between the fixed splitting components. The movable splitting component is arranged to coact with either of the stationary splitting components to split a log placed longitudinally therebetween. The carriage is driven in opposite directions by an operating mechanism which includes a nut carried by the carriage for movement therewith and a screw having one end fixed axially by and rotatably supported in bearings located at one end of the frame. The screw extends through the nut in threaded engagement therewith, with the opposite end of the screw preferably extending in an unsupported cantilever fashion beyond the nut and carriage. A reversible drive motor is connected to the supported end of the screw for rotatably driving the screw in one direction to move the carriage towards one of the fixed splitting components, and in the opposite direction to move the carriage towards the other of the fixed splitting components.

10 Claims, 8 Drawing Figures

DOUBLE ACTING LOG SPLITTER

BACKGROUND OF THE INVENTION

This invention relates to double acting power operated log splitters.

Examples of known single-acting hydraulically powered log splitters are shown in U.S. Pat. Nos. 4,284,113 (Nordlin); 4,275,778 (Kotas); 4,103,724 (Braid); 3,242,955 (Hellstrom); and 3,077,214 (Brukner). The pumps, piston-cylinder assemblies and associated connecting lines and controls required for such splitters are relatively heavy, expensive and prone to leakage of hydraulic fluid.

Examples of known double-acting hydraulically powered log splitters are shown in U.S. Pat. Nos. 3,974,867 (Butas) and 3,319,675 (Bles). These double-acting versions suffer from the same drawbacks as mentioned above in connection with hydraulically powered single-acting splitters. Furthermore, because the piston-cylinder assemblies of double-acting splitters must of necessity be offset laterally from the axes of the logs being split, the resulting torques imposed on the seals and O-rings associated with such piston-cylinder assemblies further aggravate leakage problems. Also, because hydraulic pistons necessarily develop different forces during forward and reverse strokes due to the hydraulic displacement of the piston rods, the hydraulic systems of double-acting splitters must be oversized in order to achieve a stated minimum rating. This further increases the size, weight and cost of such systems.

As shown for example in U.S. Pat. No. 4,141,395 (Artz); 4,121,636 (James); 4,116,251 (Graney); 1,283,195 (Hunter); 1,189,999 (Peter); 111,333 (Ficht); and Swiss Pat. No. 231,752 (Suffert-Burner), it is well known to use mechanical threaded spindle or ratchet drives to power single-acting log splitters. However, such systems have not been employed previously in double-acting splitters, inspite of the advantages to be derived from doing so, as will hereinafter become more apparent.

SUMMARY OF THE PRESENT INVENTION

A basic object of the present invention is the provision of a double-acting log splitter wherein a movable splitting component is driven with equal force in opposite directions between opposed mutually spaced fixed splitting components.

Another object of the present invention is the provision of an improved double-acting log splitter embodying a simple relatively lightweight and inexpensive threaded spindle drive system.

Another object of the present invention is the provision of a threaded spindle drive system for a double-acting log splitter which is simple to operate and capable of undergoing extended use without breaking down. Still another objective of the present invention is the provision of a non-hydraulic drive system for a double-acting log splitter having limited maintenance requirements.

In a preferred embodiment of the invention to be described hereinafter in greater detail, the log splitter includes an elongated frame having a pair of mutually spaced fixed splitting components mounted thereon. A movable splitting component is carried by a carriage which is shiftable in opposite directions along the length of the frame between the fixed splitting components. Preferably, the fixed splitting components comprise sharpened blades against which logs are driven by the movable splitting component. Alternatively, however, it would be possible to mount the blades in an oppositely facing arrangement on the carriage for coaction with opposed fixed contact faces on the frame.

The carriage carries a nut which is threadedly engaged by a screw having at least one end rotatably and axially supported in bearings carried by the frame. The opposite end of the screw preferably extends in an unsupported cantilever fashion beyond the nut and carriage. A reversible drive is connected to the screw at the end supported by the bearings.

The drive preferably consists of a reversible electric motor having its output shaft arranged coaxially with and coupled to the screw.

The frame preferably has a top wall, opposed depending side walls and inwardly extending flanges spaced one from the other to define a slot extending along the frame underside. The fixed splitting components preferably are mounted on the top wall of the frame.

The carriage preferably consists of a unitary casting having a base underlying the inturned flanges of the frame, and sides extending upwardly from the carriage base along and outside the frame side walls, with the movable splitting component being attached to the upper ends of the carriage sides at a location transversally overlying the frame top wall. The carriage further includes an integral cradle which is located between the frame side walls. The cradle is connected to the carriage base by a web extending through the slot between the inturned frame flanges. The nut is carried by the cradle, the latter having guide members captured between the top wall and inturned bottom flanges of the frame.

Preferably, the guide members have flat surfaces in slidable contact with the top wall and bottom flanges of the frame, thereby avoiding load concentrations which might otherwise tend to distort the bottom flanges.

DETAILED DESCRIPTION OF PREFERRED EMBODIMENT

Figure 1:
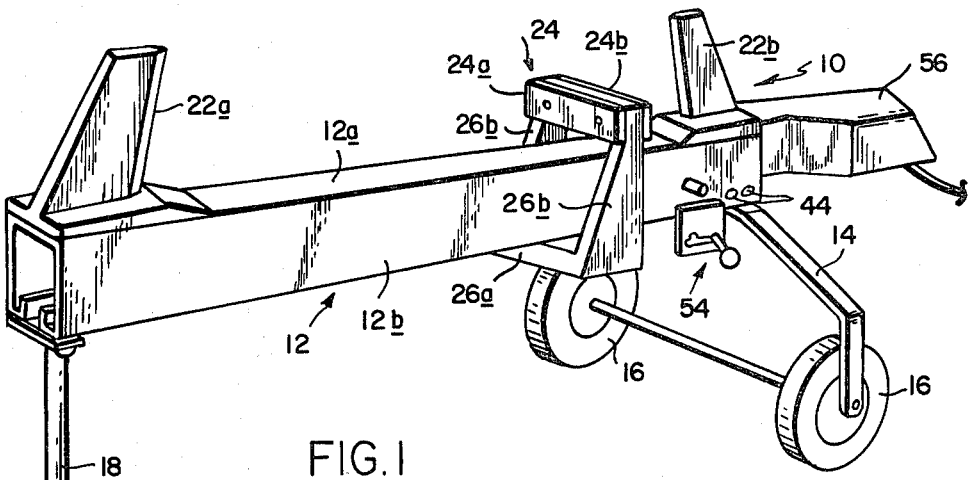
FIG. 1 is a perspective view taken from one side of a double-acting log splitter in accordance with the present invention.
Figure 2:
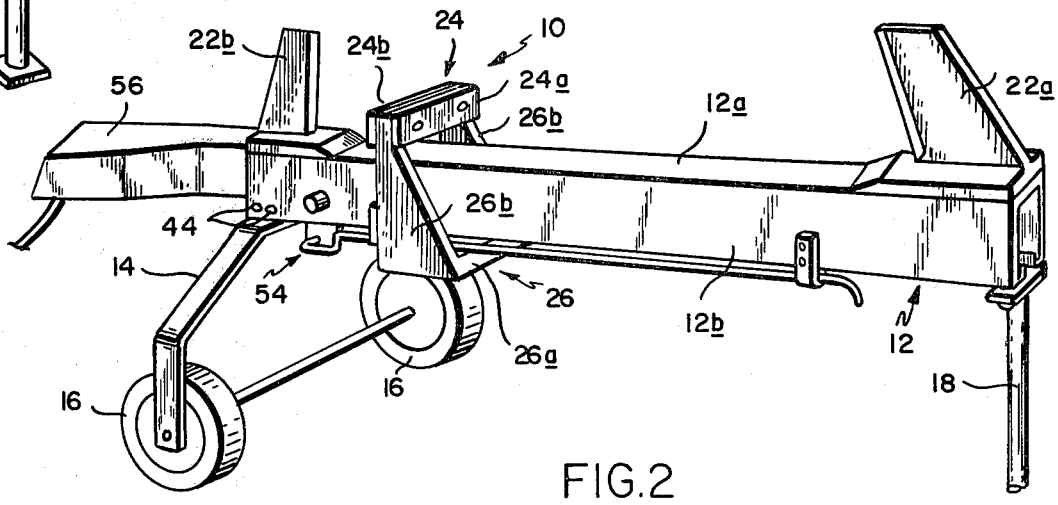
FIG. 2 is a perspective view of the same log splitter taken from the opposite side.

Referring now to the drawings, a preferred embodiment of a double-acting log splitter in accordance with the present invention is generally indicated at 10. The log splitter has a longitudinally extending frame 12 supported at one end by dual legs 14 with wheels 16 at their lower ends, and at the opposite end by a single leg 18. The frame has a top wall 12*a*, opposed depending side walls 12*b* and inwardly extending bottom flanges 12*c* spaced one from the other to define a slot 20 extending along the underside of the frame. A pair of fixed splitting components, in this case confronting sharpened blades 22*a*, 22*b*, are spaced along the length of and are mounted on the top wall 12*a* of the frame. A movable splitting component 24 is carried by a carriage 26 which is shiftable in opposite directions along the length of the frame 12 between the fixed splitting components 22*a*, 22*b*.

The carriage 26 comprises a unitary casting having a base 26*a* underlying the inturned bottom flanges 12*c* of the frame 12. Sides 26*b* extend upwardly from the base 26*a* externally along the frame side walls 12*b*. The movable splitting component 24 comprises plate members 24*a*, 24*b* which extend between and are fixed to the upper ends of the sides 26*b* at a location transversally overlying the frame top wall 12*a*. The carriage 26 further includes a trough-shaped cradle 26*c* located between the frame side walls 12*b*. The cradle 26*c* is connected to the base 26*a* by an intermediate web 26*d* extending vertically through the slot 20.

Guide members 28 are connected to the cradle 26*c* by pins 30 and bushings 32. This arrangement provides for limited pivotal movement of the guide members about axes extending transversally in relation to the direction of carriage movement, which coincides of course with the longitudinal axis of the frame 12. The guide members 28 have a generally rectangular configuration with opposed upper and lower flat contact surfaces 28*a*, 28*b* which are arranged to be captured between and to slidably contact the frame top wall 12*a* and L-shaped liners 34 on the inturned flanges 12*c*.

The cradle 26*c* is adapted to receive a nut 36 which forms part of an operating means for shifting the carriage 26 to and fro. The cradle fixes the nut against axial movement relative to the carriage, while at the same time allowing for some limited lateral play to develop between the nut and cradle. The operating means further includes a screw 38 threaded through the nut. One end of the screw is fixed axially by and rotatably supported in a pair of bearings 40*a*, 40*b*. Bearing 40*a* is retained in a housing component 42 secured to the end of the frame 12 by any convenient means, for example transverse bolts 44. Bearing 40*b* is retained in an adjacent housing component 46 fixed to housing component 42. The opposite end of the screw member preferably extends in an unsupported cantilever fashion as at 38' (See FIG. 3) beyond the nut 36 and carriage 26.

The screw 38 is rotatably driven by a reversible drive which preferably comprises an electric motor 48 fixedly connected to the housing component 46. The output shaft 50 of motor 48 is aligned coaxially with the screw 38 and is coupled directly thereto. Preferably, this is accomplished by having the end of the output shaft axially received in a socket 52 in the end of the screw, with the output shaft and socket having flat surfaces in cooperative mechanical engagement.

An appropriate control mechanism 54 is employed to start, stop and reverse motor 48. This control mechanism is the subject of a companion application being filed concurrently herewith. A protective hood 56 overlies the motor 48 in order to protect it from the elements.

Figure 3:
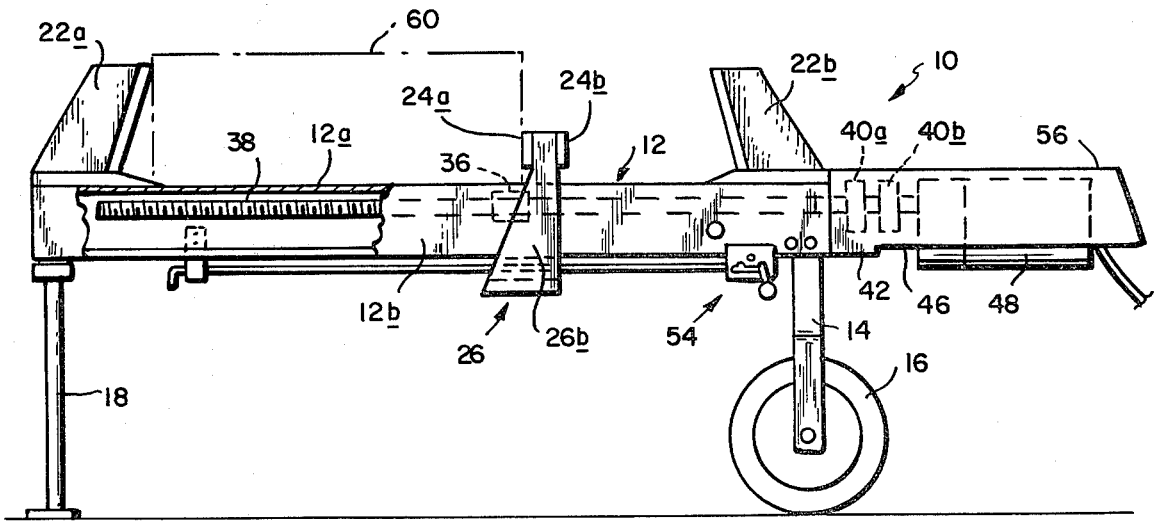
FIG. 3 is a view in side elevation with portions broken away.
Figure 4:
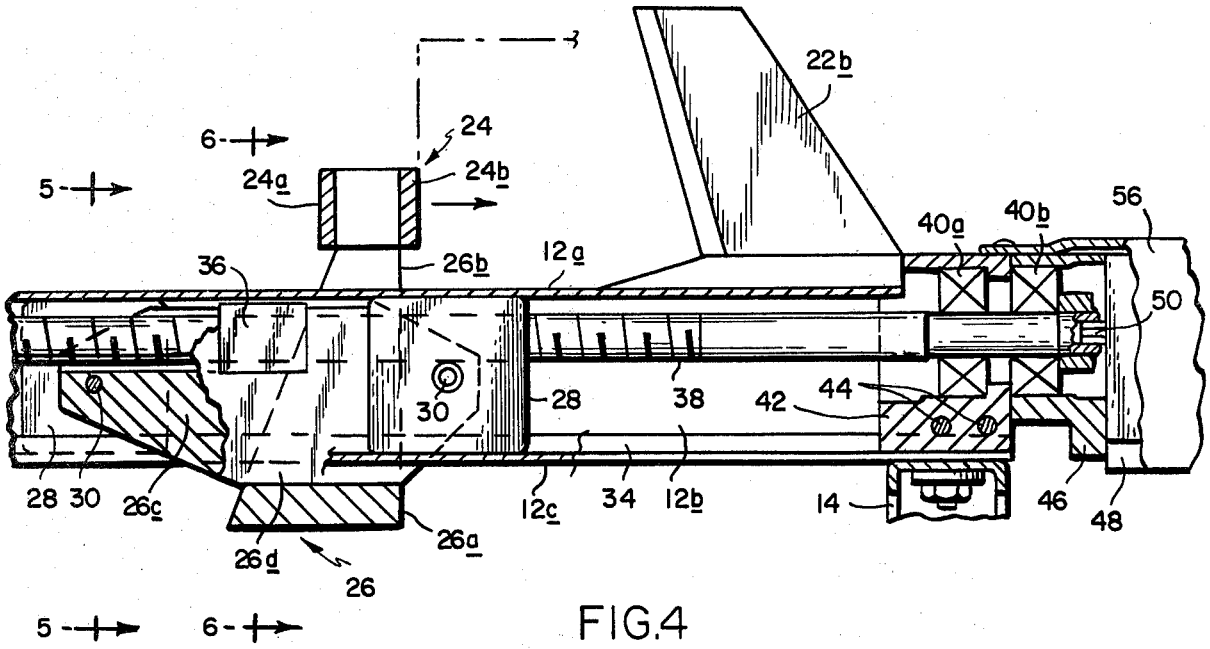
FIG. 4 is an enlarged sectional view in side elevation of a portion of the frame, carriage and drive mechanism.
Figure 5:
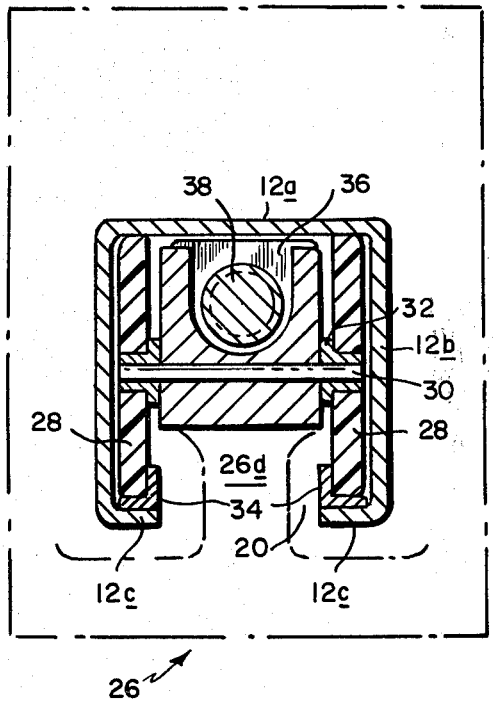
FIGS. 5 and 6 are enlarged sectional views taken respectively along lines 5—5 and 6—6 of FIG. 4.
Figure 6:
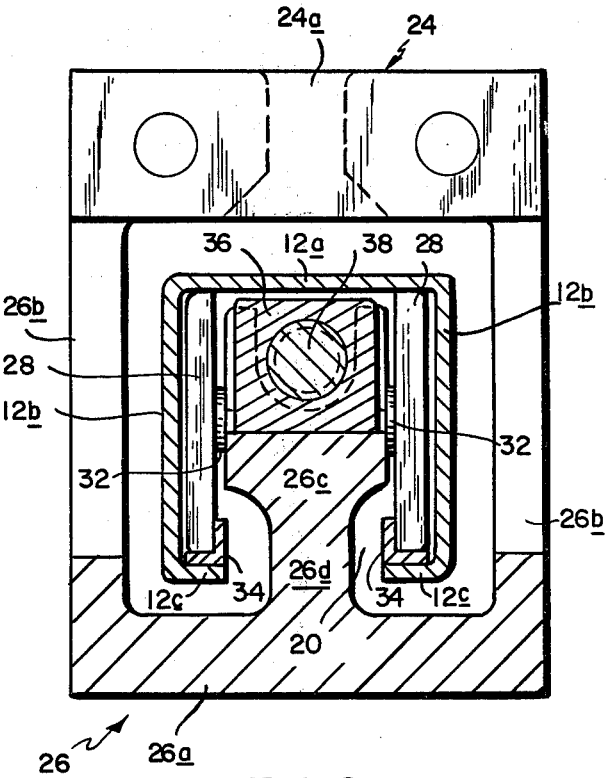
Figure 7:
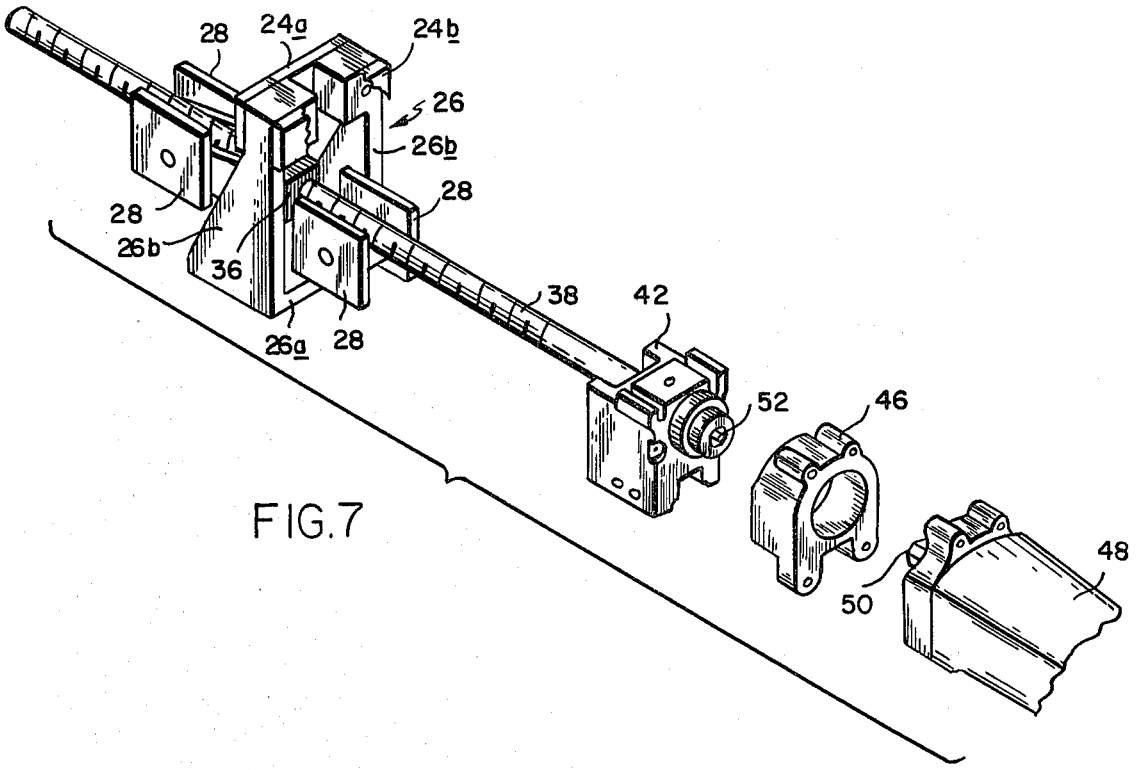
FIG. 7 is a perspective partially exploded view of the carriage and associated drive components.
Figure 8:
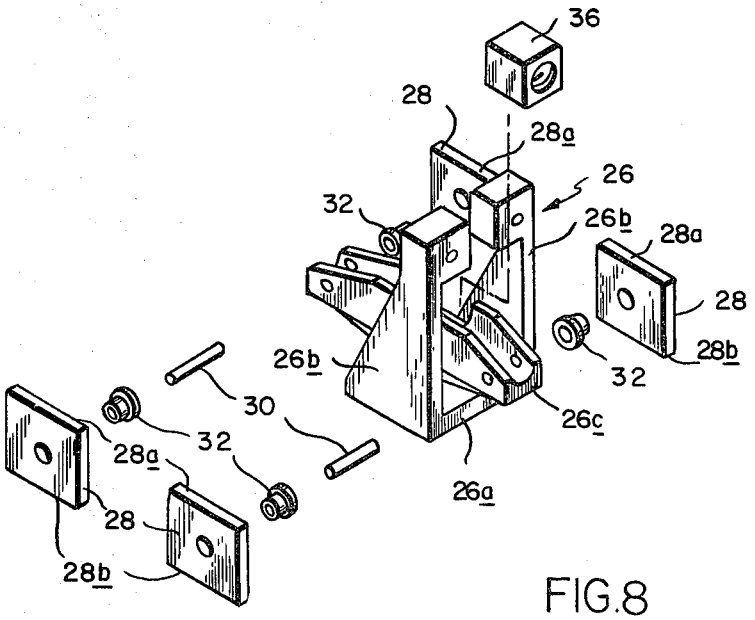
FIG. 8 is another perspective view showing the carriage, with the slide members and nut member appearing in an exploded relationship.

When operating the log splitter 10, as illustrated for example in FIG. 3, a log 60 is placed on the top wall 12*a* of the frame 12 between blade 22*a* and the contact face 24*a* on carriage 26. The motor 48 is then energized to move the carriage 26 towards the blade 22*a*, thus causing the log to split. Another log can then be positioned between blade 22*b* and contact face 24*b*. The direction of carriage travel is then reversed by reversing motor 48. This "double-acting" feature of the splitter is extremely efficient since the carriage experiences little lost motion as it moves to and fro between the blades 22*a*, 22*b*.

In light of the foregoing, it will now be evident to those skilled in the art that the log splitter of the present invention offers a number of significant and heretofore unavailable advantages. For example, in contrast to conventional hydraulically powered double-acting log splitters where the movable splitting components are shifted in opposite directions with unequal forces, the carriage-mounted movable splitting component 24 of the present invention is shifted in either direction with an equal force, thus avoiding the necessity to oversize components in order to achieve a stated capacity. Also, by allowing one end 38' of the screw to extend in an unsupported cantilever fashion beyond the nut and cradle, and by allowing for some limited lateral play of the nut 36 relative to the cradle 26*c*, some degree of eccentric rotation resulting from distortion and/or misalignment can be accommodated without adversely affecting operation of the splitter. Slight distortions and misalignments are to be expected with equipment of this type, particularly considering the adverse conditions under which they are frequently required to operate.

The coaxial alignment and direct coupling of the motor's output shaft 50 to the screw member 38 is also advantageous in that it simplifies assembly and avoids the need to resort to complicated and expensive gearing.

The screw member 38 and nut 36 are contained within the frame member 12, thus protecting these components from contamination by wood chips or from damage by being struck accidentally with heavy objects.

When the contact faces 24*a*, 24*b* engage one end of a log during a splitting operation, the carriage 26 experiences considerable torque which must be resisted by the top wall 12*a* and flanges 12*c* of the frame member 12. The flat contact faces 28*a*, 28*b* of the guide members 28 assist in spreading these forces over wider areas, thereby avoiding any localized deformation of the flanges 12*c*.

I claim:

1. A double acting log splitter comprising:

a frame defining a longitudinally extending log supporting surface;

a pair of mutually spaced fixed splitting components arranged in a confronting relationship at opposite ends of said supporting surface;

a carriage mounted on said frame for movement in opposite directions between said fixed splitting components;

a movable splitting component mounted on said carriage at a location overlying said supporting surface, said movable splitting component being arranged to coact with either of said fixed splitting components to split a log positioned axially therebetween on said supporting surface;

a screw located beneath and extending in a direction parallel to the length of said supporting surface;

bearing means for rotatably supporting one end portion of said screw, with the remainder of said screw extending in cantilever fashion from said bearing means;

a nut connected to said carriage and threaded onto said screw; and reversible drive means connected to the said one end portion of said screw for rotatably driving said screw in one direction to move said nut and said carriage towards one of said fixed splitting components, and for rotatably driving said screw in the opposite direction to move said nut and said carriage towards the other of said fixed splitting components.

2. The log splitter of claim 1 wherein said nut is constrained against axial movement relative to said carriage while being permitted to move laterally in relation thereto.

3. The log splitter of claim 1 wherein said fixed splitting components comprise confronting blade members, and wherein said movable splitting component comprises a means on said carriage for forcing logs against either of said blade members.

4. The log splitter of claim 1 wherein said reversible drive means comprises an electric motor having an output shaft arranged coaxially with said screw.

5. The log splitter of claim 4 wherein said output shaft is axially received in a socket in said one end of said screw, said output shaft and said socket having flat surfaces in cooperative mechanical engagement.

6. The log splitter of claim 1 wherein said frame has a top wall defining said log supporting surface, opposed depending side walls, and inwardly extending bottom flanges spaced on from the other to define a slot extending along the underside of said frame.

7. The log splitter of claim 6 wherein said carriage has a base underlying the inturned flanges of said frame, and sides extending upwardly from said base along the side walls of said frame, and wherein said movable splitting component extends between and is fixed to the upper ends of said sides.

8. The log splitter of claim 7 wherein said carriage further includes a cradle located between the side walls of said frame, said cradle being adapted to receive and support said nut, said cradle being connected to said base by a web extending through said slot.

9. The log splitter of claim 8 wherein said carriage further includes guide members positioned interiorily of the side walls of said frame and between the top wall and inturned flanges thereof, said guide members being connected to said cradle for pivotal movement about axes extending transverally to the direction of movement of said carriage.

10. The log splitter of claim 9 wherein said guide members have opposed flat surfaces arranged to be captured between and to slidably contact the top wall and the inturned bottom flanges of said frame.

* * * * *